United States Patent [19]

Aspenlind

[11] 4,091,495

[45] May 30, 1978

[54] GAS CYLINDER WASHING, DRAINING AND/OR DRYING APPARATUS

[76] Inventor: Åke Lars. G. Aspenlind, 9595 Mira Del Rio Dr., Sacramento, Calif. 95827

[21] Appl. No.: 686,920

[22] Filed: May 17, 1976

[51] Int. Cl.[2] ..... A47L 5/38

[52] U.S. Cl. ..... 15/304; 134/43; 134/152; 134/171

[58] Field of Search ..... 15/302, 303, 304, 306 B, 15/316 R; 134/43, 152, 166 R, 171

[56] References Cited

U.S. PATENT DOCUMENTS

| | | | |
|---|---|---|---|
| 1,893,652 | 1/1933 | Reich | 134/150 X |
| 2,568,949 | 9/1951 | Cookson | 134/152 X |
| 2,814,575 | 11/1957 | Lange | 134/152 X |
| 3,765,050 | 10/1973 | Van Allman | 15/304 |
| 3,956,791 | 5/1976 | Rutten | 15/304 X |

*Primary Examiner*—Christopher K. Moore
*Attorney, Agent, or Firm*—Seed, Berry, Vernon & Baynham

[57] ABSTRACT

Cylinders are mounted on an invertible frame. A reciprocably mounted header is provided on the movable frame for engaging the necks of the cylinders to hold the cylinders on the movable frame when inverted and to inject a drying fluid into the cylinders. The movable frame and movable header on the movable frame are adapted for holding various sizes of cylinders.

9 Claims, 9 Drawing Figures

FIG. 4
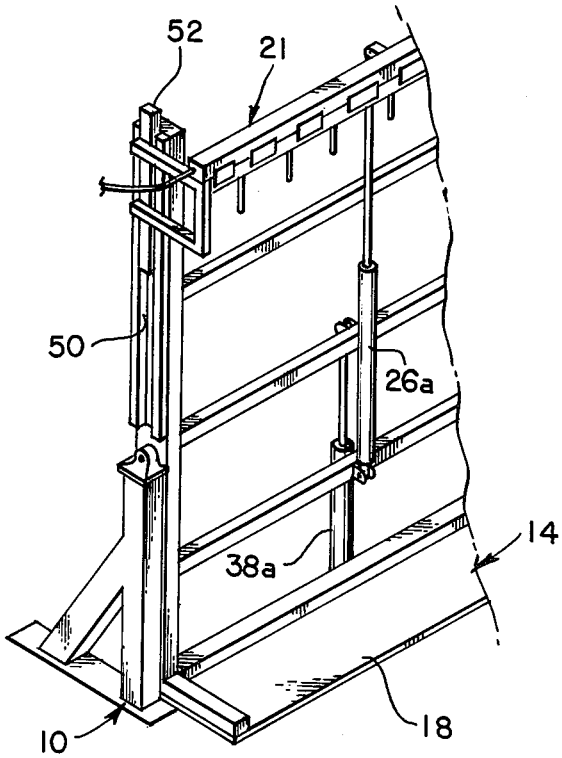
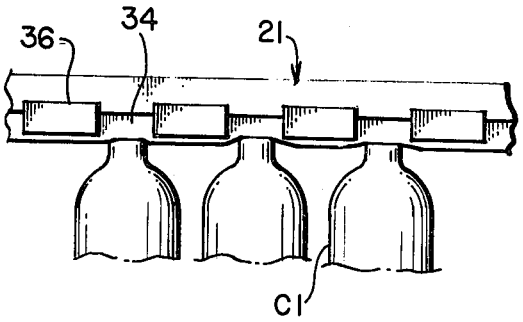
FIG. 5
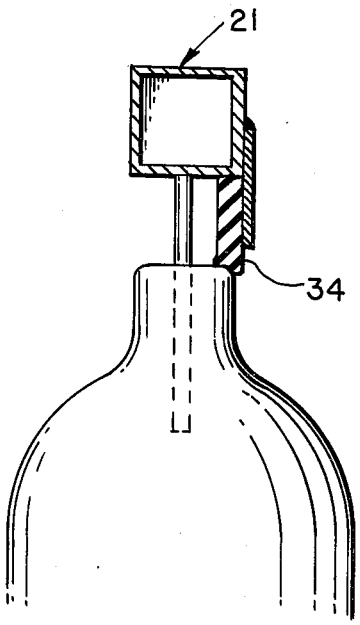
FIG. 6
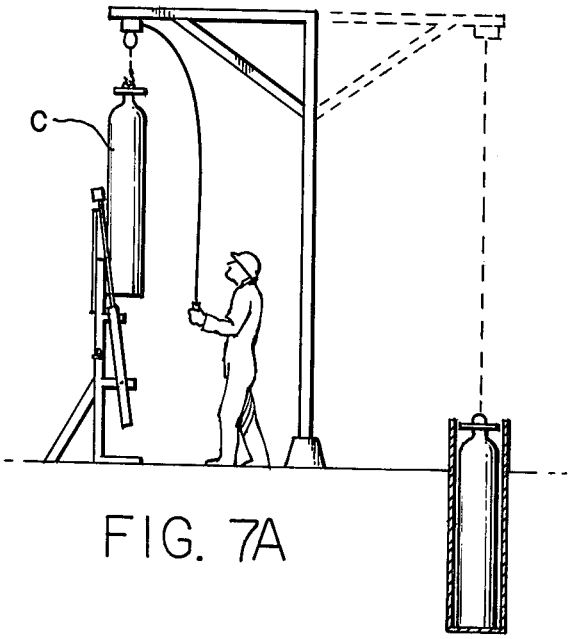
FIG. 7A
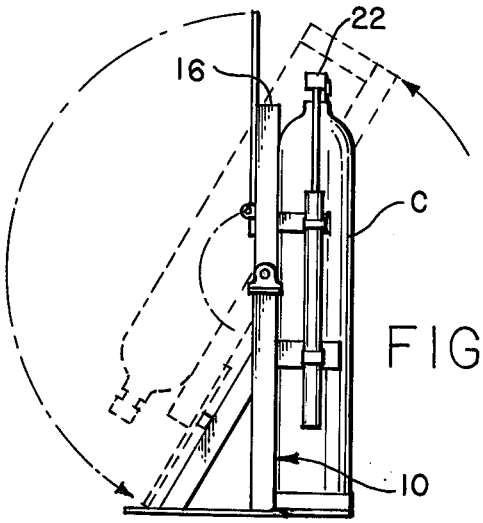
FIG. 7B

GAS CYLINDER WASHING, DRAINING AND/OR DRYING APPARATUS

BACKGROUND OF THE INVENTION

1. Field of the Invention

This invention pertains to apparatus for washing, draining and/or drying gas cylinders.

2. Description of the Prior Art

Various techniques have been used heretofore for washing, draining and/or drying gas cylinders. These cylinders must be cleaned and dried after testing to remove impurities that have become deposited in the cylinders. One such device for cleaning the cylinders is shown in U.S. Pat. No. 1,893,652. This patent shows a device which holds a set of cylinders into which steam is injected, in an upright position. The cylinders can be moved into an inverted position to drain the interior of the cylinder. The apparatus of this patent, however, is not adjustable to a accommodate different sizes of cylinders as are customarily found in the industry.

SUMMARY OF THE INVENTION

It is an object of this invention to provide an improved apparatus for washing, draining or drying gas cylinders.

It is another object of this invention to provide an apparatus for handling gas cylinders which is adaptable to cylinders of various heights and diameters.

It is still another object of this invention to provide an apparatus for handling gas cylinders in which the apparatus can be easily adjusted for holding the cylinders when in an inverted position.

It is also another object to provide for draining and subsequent drying of the cylinders while in a single inverted position.

Basically these objects are obtained by providing on a stationary frame, a movable frame which is pivotally mounted on the stationary frame. The movable frame is provided with a reciprocal header which can be moved down into engagement with the necks of gas cylinders. The header is provided with injecting means for injecting a washing or drying fluid into the opening of the neck of the cylinder. The movable frame is inverted by power means and the header on the movable frame is also reciprocated by powered means.

As is readily apparent the apparatus enables an operator to quickly stack or load the cylinders on the movable frame and through the power controls lower the header down into clamping engagement with the necks of the cylinders with the steam or gas drying medium injecting means inserted within the openings in the necks. Furthermore the adjustability of the header will accommodate various sizes of cylinders.

BRIEF DESCRIPTION OF THE FIGURES OF THE DRAWING

FIG. 4 is a fragmentary isometric of a second embodiment of the apparatus.

FIG. 5 is a fragmentary detail illustrating the bumpers for holding the gas cylinders.

FIG. 6 is a side elevation, partly in section, of one of the bumpers engaged with a gas cylinder.

FIG. 7A and 7B illustrate one loading technique for placing gas cylinders in the drying apparatus.

FIG. 7A shows a cylinder being placed in the drying apparatus and FIG. 7B illustrating the cylinder in an inverted position.

DETAILED DESCRIPTION OF THE PREFERRED EMBODIMENTS

Figure 1:
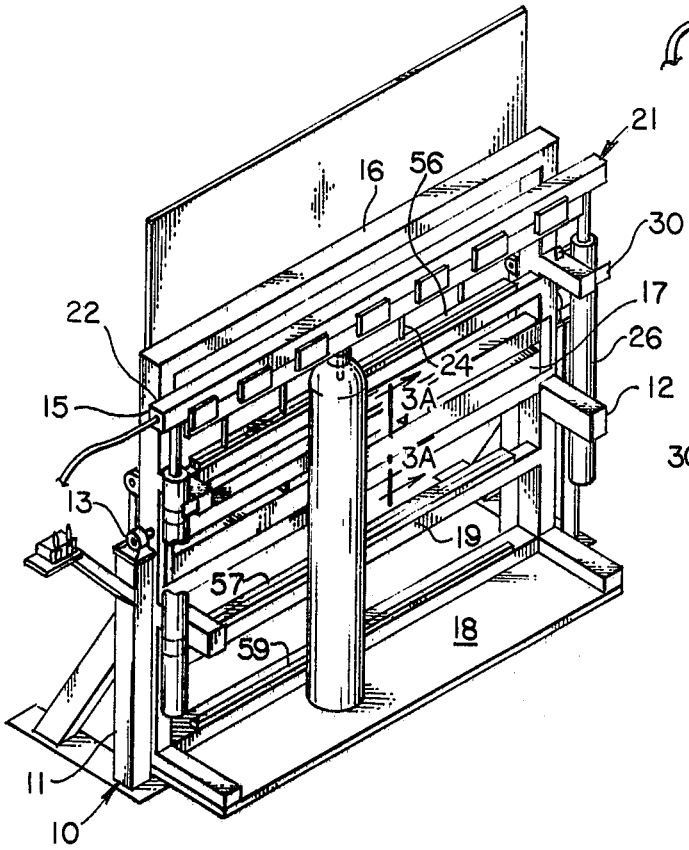
FIG. 1 is an isometric of the preferred embodiment of the cylinder washing, draining and/or drying apparatus.
Figure 2:
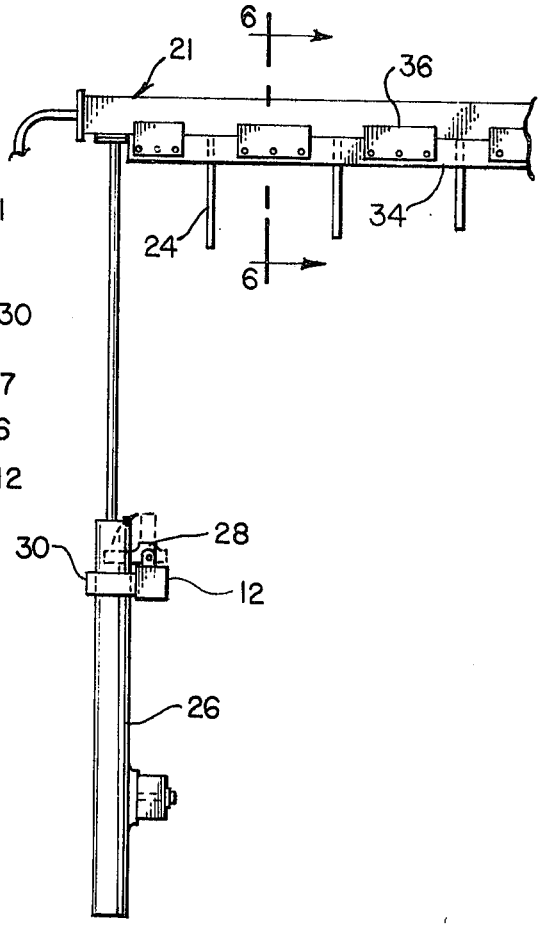
FIG. 2 is a fragmentary front elevation of the apparatus of FIG. 1.
Figure 3:
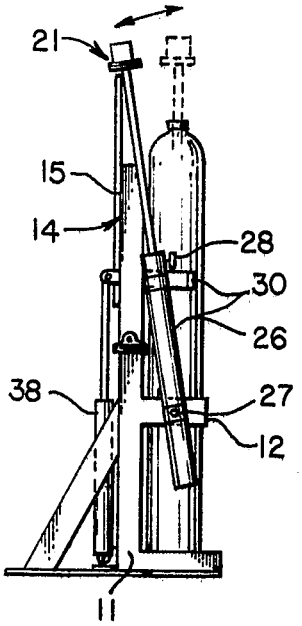
FIG. 3 is a side elevation of the apparatus shown in FIG. 1.
Figure 3A:
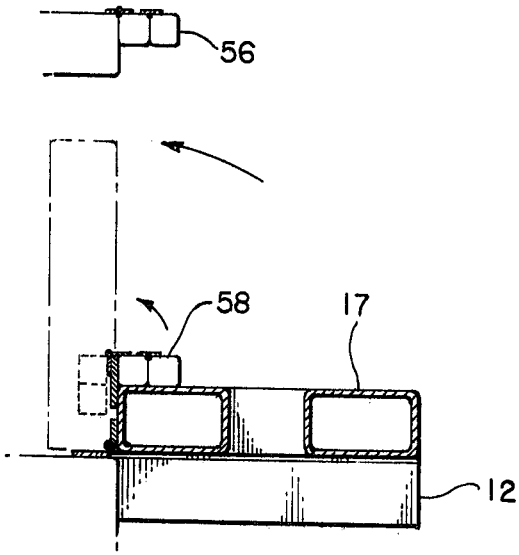
FIG. 3A is a vertical fragmentary section taken along line 3A–3A of FIG. 1.

As best shown in FIGS. 1,2 and 3 the cylinder washing, draining and/or drying apparatus is provided with a stationary frame 10 having a pair of spaced uprights 11 each of which mounts a pivot block 13. Mounted in the stationary frame is a movable frame 14. The movable frame includes a pair of side members 15 joined by a top member 16 and provided with arms which mount a fixed bottom shelf 18. Supports 19 interconnect the side frames 15 for added rigidity. An upper shelf 17 for substantially shorter cylinders is hinged to a support of the movable frame for movement between a stored portion (FIG. 1) and an operative position (FIG. 3A). The side frames 15 are pivotally mounted on the pivot members 13 of the stationary frame so that the movable frame can be inverted into the position shown in FIG. 7B.

Mounted for vertical reciprocation on the movable frame is a header 21 which comprises a hollow chamber 22 interconnected with a plurality of injector rods 24 each of which is successively shorter than the next adjacent rod as shown in FIG. 2. The header is reciprocally moved by a pair of cylinders 26 which in turn are pivotally mounted as at 27 to the movable frame. Thus the cylinders can move the header not only vertically but also can be manually swung into the solid line position shown in FIG. 3. The solid line position axially aligns the header over the open necks of the cylinders. The alignment is achieved through a stopper plate 30 which prevents further forward movement and a movable dog 28 which can be moved downwardly, as shown in FIG. 2, to prevent rearward movement of the header.

The different lengths of the injector rods 24 are provided so that the operator can visually observe the first longest rod entering the neck of a cylinder before concerning himself with whether the next adjacent cylinder is perfectly aligned beneath the injector rod from the header. Thus, the operator can slowly move the header downwardly so that each of the injector rods 24 can be easily positioned with the openings of the next of the cylinders rather than try to simultaneously guide the injector rods into all of the cylinders at the same time.

The header is also provided with a resilient bumper 34 which is secured to the header by brackets 36. The bumper is preferably rectangular in shape and while a bumper can be provided both on the front and on the rear sides of the header to clamp against the top surfaces of the necks of the cylinders a single bumper is advantageously employed to facilitate draining of the fluid contents of the gas cylinders when inverted. The resilient bumper can conform to irregularities in the length of the cylinders as is best shown by the cylinder C1 in FIG. 5.

A pair of cylinders 38 are provided to swing the movable frame into the inverted position. In the modified form of the invention shown in FIG. 4 a single cylinder 38*a* is centrally mounted on the movable frame 14*a*.

In the modified embodiment the movable frame is essentially the same as the movable frame 14 of the preferred embodiments with the exception that the pair of cylinders 26 is replaced by a single cylinder 26*a* and the header 21 is reciprocally mounted in tracks 50 on either side of the movable frame. The header, for this purpose, is provided with a guide member 52 at each end of the header for tracking in the tracks 50. Thus, while this embodiment cannot swing the header out of alignment with the cylinders the header can be moved vertically a sufficient distance to allow easy placement of the cylinders on the shelf 18.

In operation the cylinders are generally hydrostatically tested and after testing contain water. Before refilling with gas the bottles are then emptied and dried. The gas cylinders are placed on the shelf 18 and the operator moves the header down slowly so that the ejector rods will enter into the bottles and the rubber bumper will by pressing against the top surface of the necks of the bottles hold the bottles in position against the shelf 18. Next the bottles are inverted into the position shown in FIG. 7B and steam or gas is injected so that water will flow out and the hot steam, nitrogen, or hot air will displace the remaining water and dry the inside surface of the bottles. As is readily apparent, several bottles may be dried simultaneously with slight variations being accommodated solely by the bumper 34. For bottles of smaller height and diameter the header can be moved down further to easily accommodate the smaller height and hinged spacer blocks 57 and 59 are provided to swing down into engagement with the smaller diameter cylinders. When cylinders are substantially shorter the shelf 17 is swung down for supporting the cylinders. Likewise, second spacer blocks 56 and 58 are provided to swing down to engage the sides of the smaller diameter cylinders.

It should be apparent that variations will be apparent to one skilled in the art without departing from the principles described herein. Accordingly the invention is not to be limited to the specific embodiments illustrated.

The embodiments of the invention in which a particular property or privilege is claimed are defined as follows:

1. Apparatus for washing, draining, and/or drying gas cylinders having cylindrical bodies, each having a neck and an axial opening in the neck communicating with the interior of the cylindrical body, comprising:

a stationary frame, a movable frame pivotally carried on said stationary frame and having a shelf for supporting the cylindrical bodies, a vertically adjustable header reciprocably mounted on said movable frame and having bumper means on said header for engaging the necks of the cylinders for clamping the cylinders against the shelf so that the cylinders are held against movement during pivoting of the movable frame to an inverted cleaning, draining, or drying position, means for reciprocating the header toward said shelf and adapted for moving the bumper against the necks of the cylinders on the shelf to clamp the cylinders on the shelf, means for pivoting said movable frame sufficient to invert the movable frame for draining the cylinders by gravity, and means on said header adapted for injecting a fluid into the cylinders.

2. The apparatus of claim 1, said injecting means including a plurality of hollow rods each successively shorter than the next so that the ends of the rods can be introduced into a row of approximately equal length cylinders one at a time.

3. The apparatus of claim 1, including vertically spaced spacer means mounted on said movable frame and movable laterally outwardly thereon for engagement with the cylinder bodies of smaller diameters for supporting the cylinder bodies as they are inverted.

4. The apparatus of claim 1, wherein said bumper means comprises a resilient pad adapted to align with the upper surface of the necks of the cylinders to push the cylinders downwardly against the shelf and being positioned to expose the axial openings of the cylinders when inverted for ease of draining the fluid therefrom.

5. The apparatus of claim 1, said means for reciprocating the header including pivot means for pivoting the header out of alignment with the shelf for ease of inserting cylinders on the shelf.

6. The apparatus of claim 5, including retractable stop means for holding the header after pivoting into a position in alignment with the shelf for assuring alignment of the necks of the cylinders with said header.

7. The apparatus of claim 1, said reciprocably mounted header including guide means on said movable frame for guiding the vertical movement.

8. The apparatus of claim 1, including a second shelf movable outwardly into an operative position between the header and the first shelf for holding substantially shorter cylinders.

9. The apparatus of claim 8, including vertically spaced spacer means mounted for laterally outward movement on said movable frame between the second shelf and the header for supporting cylinder bodies of small diameters as they are inverted.

* * * * *